US005839825A

United States Patent [19]

Krzywdziak

[11] Patent Number: 5,839,825

[45] Date of Patent: Nov. 24, 1998

[54] AGITATOR LID FOR A CAN OF COLORING SUBSTANCE ON PAINT-AGITATION MACHINES

[75] Inventor: Alain Krzywdziak, Orleans la Source, France

[73] Assignee: F.A.S., Orleans Cedex, France

[21] Appl. No.: 899,234

[22] Filed: Jul. 23, 1997

[30] Foreign Application Priority Data

Jul. 23, 1996 [FR] France ..... 96 09218

[51] Int. Cl.[6] ..... B01F 7/24

[52] U.S. Cl. ..... 366/247; 366/286; 366/331; 366/605; 384/243

[58] Field of Search ..... 366/197, 198, 366/242–252, 254, 285, 286, 289, 318, 320, 331, 347, 605; 384/240, 243–244, 420, 425, 908

[56] References Cited

U.S. PATENT DOCUMENTS

| | | | |
|---|---|---|---|
| 569,428 | 10/1896 | Saxer | 366/605 X |
| 1,775,345 | 9/1930 | Henschel | 366/605 X |
| 2,027,297 | 1/1936 | Tramposch | 366/605 X |
| 2,814,473 | 11/1957 | Kroll | 366/247 |
| 4,380,399 | 4/1983 | Godat et al. | 366/605 X |
| 4,926,390 | 5/1990 | Murzsa . | |
| 5,358,153 | 10/1994 | Caldwell et al. . | |
| 5,498,077 | 3/1996 | Krzywdzjak et al. . | |

FOREIGN PATENT DOCUMENTS

| | | |
|---|---|---|
| 0 035 422 A1 | 9/1981 | European Pat. Off. . |
| 0 394 087 A1 | 10/1990 | European Pat. Off. . |

*Primary Examiner*—Charles E. Cooley
*Attorney, Agent, or Firm*—Scully, Scott, Murphy & Presser

[57] ABSTRACT

An agitator lid for a can of coloring substance on paint-agitation machines of the type including an agitator spindle (7) mounted so as to be free in translation relative to the lid, provided with an axial rod (13) which is driven in rotation and with a lower agitation blade (15), the agitator spindle (7) being suitable for butt-type application on the base (17) of the can under the thrust of the blade during agitation. The agitator spindle (7) includes, at its lower end, an end piece (31) for application on the base of the can, this end piece being mounted so as to be free in rotation on the agitator spindle (7) and being provided with at least three lower projecting elements (39) suitable for coming into contact via one and the same plane perpendicular to the spindle with the surface of the base (17) of the can.

11 Claims, 2 Drawing Sheets

AGITATOR LID FOR A CAN OF COLORING SUBSTANCE ON PAINT-AGITATION MACHINES

FIELD OF THE INVENTION

The invention relates to an agitator lid for a can of coloring substance on paint-agitation machines and, particularly, to an agitator lid provided with a device which prevents contact wear by the agitators on the base of cans during agitation.

PRIOR ART

It is known that the hydrodynamic mixing effect of the agitator within the lacquer leads to the agitator spindle being applied downward with a relatively large force which, if the agitator spindle is mounted so as to be free in translation relative to the upper entrainment lid, leads to the end of the agitator spindle coming into frictional contact with the base of the can, with rapid erosion of said base. This base of the can is actually relatively thin, having a thickness equal to approximately 0.2 mm and, moreover, the particles eroded from the base may contaminate the treated lacquer.

SUMMARY OF THE INVENTION

The invention aims to remedy this drawback and proposes an agitator lid for a can of coloring substance on paint-agitation machines of the type comprising an agitator spindle mounted so as to be free in translation relative to the lid, provided with an axial rod which is driven in rotation and with a lower agitation blade, the agitator spindle being suitable for butt-type application on the base of the can under the thrust of the blade during agitation, wherein the agitator spindle includes, at its lower end, an end piece for application on the base of the can, this end piece being mounted so as to be free in rotation on the agitator spindle and being provided with at least three lower projecting elements suitable for coming into contact, via one and the same plane perpendicular to the spindle, with the surface of the base of the can.

Naturally, said three projecting elements of the end piece have all three of their lower ends arranged in one and the same plane, substantially parallel to that of the base of the can and the perimeter of the triangle thus defined contains the spindle. These projecting elements come into localized contact with the base of the can.

The end piece is preferably mounted so as to be free in rotation coaxially to the agitator spindle, although it is conceivable for a slight off-center phenomenon inside the three bearing points to exist.

This arrangement has the result that, during agitation, the agitator spindle is applied on the base of the can via its end piece which remains fixed on the base by virtue of the adhesion of the localized bearing of the projecting elements, the agitator spindle turning on the end piece. In this way, the base of the can is not eroded by the agitator spindle.

Said end piece is advantageously provided with a size in terms of height which is determined in relation to the blade so as to bring the latter to a specific optimum operating height relative to the surface of the base of the can.

Moreover, the end piece with its three points affords a stable lower seat for the rotational spindle.

Said agitator-spindle end piece is advantageously a circular plate whose diameter is slightly larger than that of the agitator-spindle rod (4–15 mm), mounted perpendicularly to the rotational spindle. The projecting elements are cylindrical fingers whose end is rounded. These fingers are arranged in a circular manner 120° from one another.

The end piece is mounted rotationally and coaxially on the agitator spindle by means of a snap-fitting device of circular configuration engaging in the end-shaft bore of the agitator spindle.

This snap-fitting device may consist of three upper clip tabs fixed in the upper central part of the end piece, the upper snout part of which interacts with a complementary skirt of the spindle shaft. This rotational mounting part of the end piece is preferably made from synthetic material with a low coefficient of friction, for example a material based on "Teflon".

The agitator spindle is preferably provided with a spirally configurated blade (spiral-shaped generatrix). The end piece with its three points according to the invention makes it possible to bring this highly efficient spiral blade to a precise reference height relative to the surface of the base of the can, at which its performance is optimal, at a high level at which vibrational mounting of the blade is no longer necessary.

This spiral blade may be mounted so as to be movable in translation on the agitator-spindle rod, at its lower part, and the end piece may be mounted so as to rotate on the blade at its lower part, coaxially with the latter, projecting beyond its lower leading edge by a specific height corresponding to the height of application of the blade on the base of the can where operation is optimal.

BRIEF DESCRIPTION OF THE DRAWINGS

An embodiment of the invention is now described with reference to the appended drawings, in which.

DESCRIPTION OF THE PREFERRED EMBODIMENT

Figure 1:
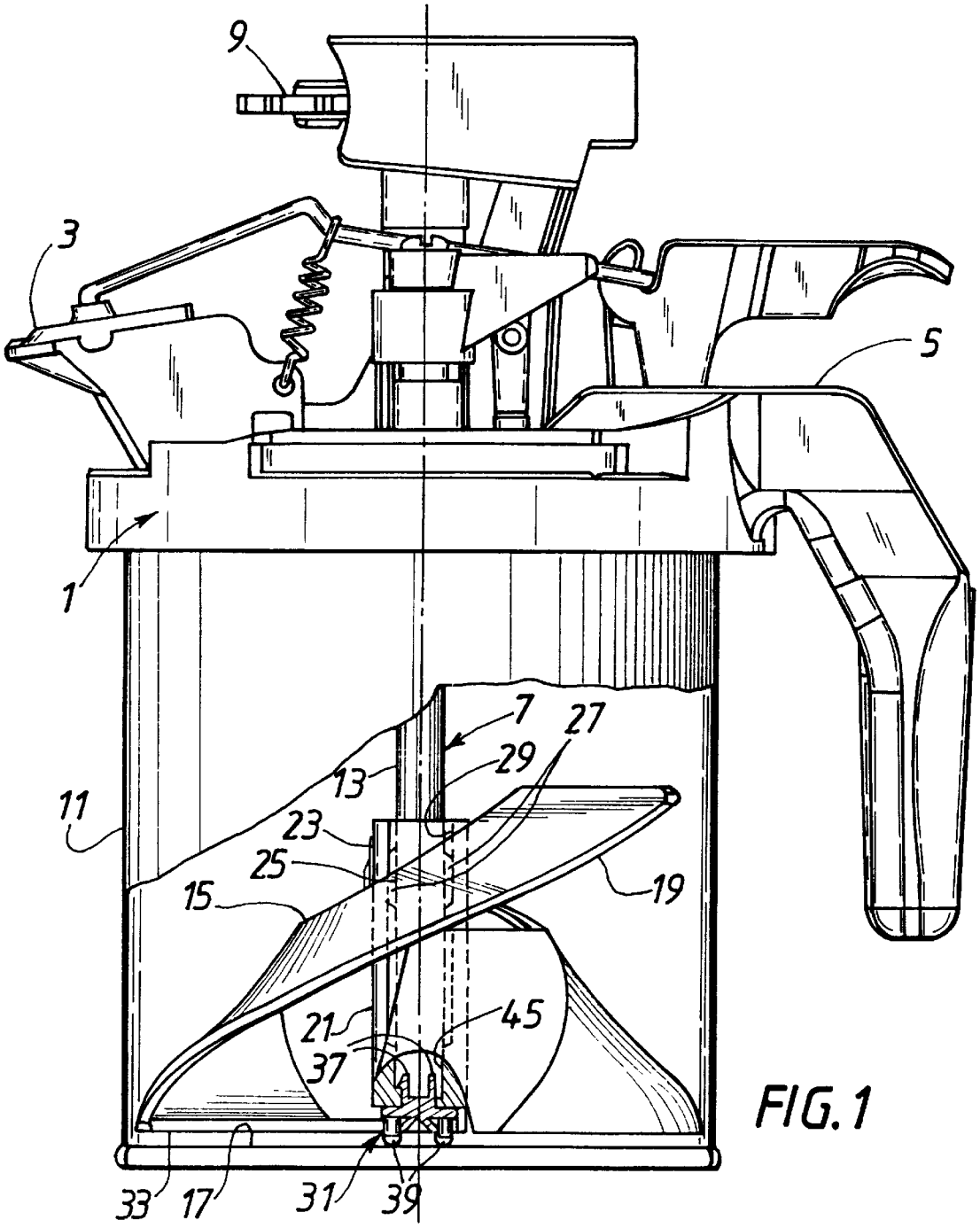
FIG. 1 is a view of an agitator lid with its can according to the invention showing, by means of a cutaway, the mounting of the bearing end piece of the agitator.

With reference to FIG. 1, the agitator lid 1 shown is a conventional model (except for the agitator), including a pouring spout 3, a handling grip 5 at the end diametrically opposed to the spout, and an agitator spindle 7 in a vertical axial position. The spindle is driven by an upper gear 9 itself engaging with a continuous chain (not shown) of an agitation machine on which the lid is mounted. This lid receives a can of coloring substance 11 underneath.

The agitator spindle 7 consists of an axial rod 13 and of a lower agitator blade 15. The blade 15 is mounted so as to be movable in translation on the spindle rod 13 at its lower part so as to descend under the hydrodynamic agitation action toward the base 17 of the can (horizontal planar surface) at a short distance from said base.

It will be noted that the rod 13 has a constant specific length, permitted by virtue of the blade being mounted in translation and adapted to use with various cans in a given capacity range, the height of said cans varying slightly from one manufacturer to another.

The blade 15 is of a type having a generatrix 19 of spiral shape whose mixing efficiency makes it possible for it to be used without having to make the agitator spindle 7 vibrate, which, in the prior art, required suspended mounting of the blade with the corresponding adaptation, in terms of height, to each can.

The blade 15 is mounted so as to slide longitudinally via its central shaft 21 on the agitator spindle, this being over a specific path. This shaft 21 includes two longitudinal shoulders 23 which are diametrically opposed and each provided with an inner groove 25 receiving a complementary rib 27 of the rod. Translation upward is limited by an upper stop 29 at the top end of each of the grooves and similarly, downward, by a lower stop.

The blade 15 also includes, at the lower end of its axial shaft 21, a lower bearing end piece 31 mounted so as to be free in rotation on said shaft and which projects downward under the lower horizontal rectilinear edge 33 of the blade. The distance h between the horizontal lower plane of the end piece and the lower edge 33 of the blade is determined as a function of the latter and of the paint to be treated (to a lesser extent) so as to obtain agitation of optimum efficiency.

Figure 3:
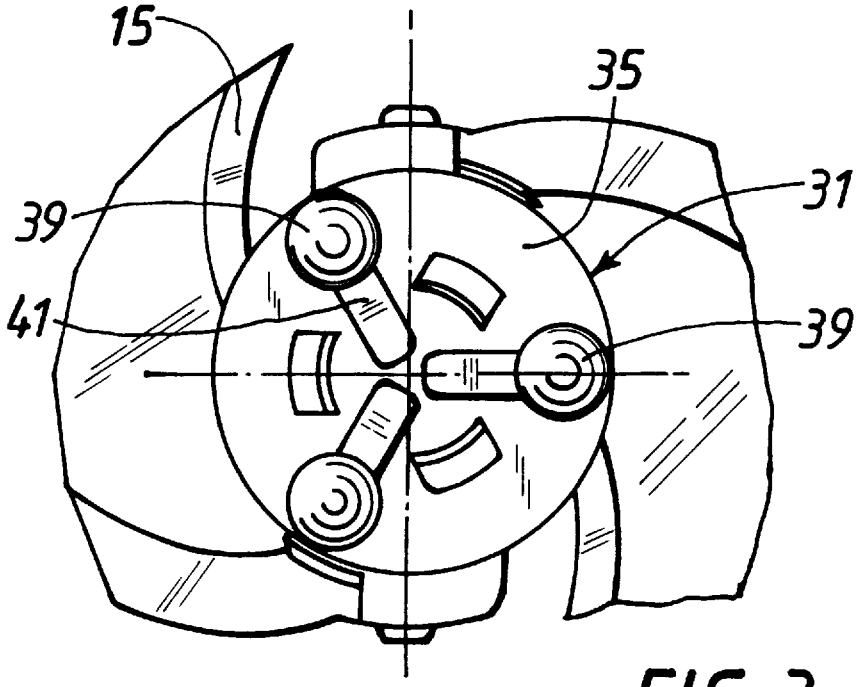
FIG. 3 is a bottom view of the bearing end piece of the agitator lid.
Figure 2:
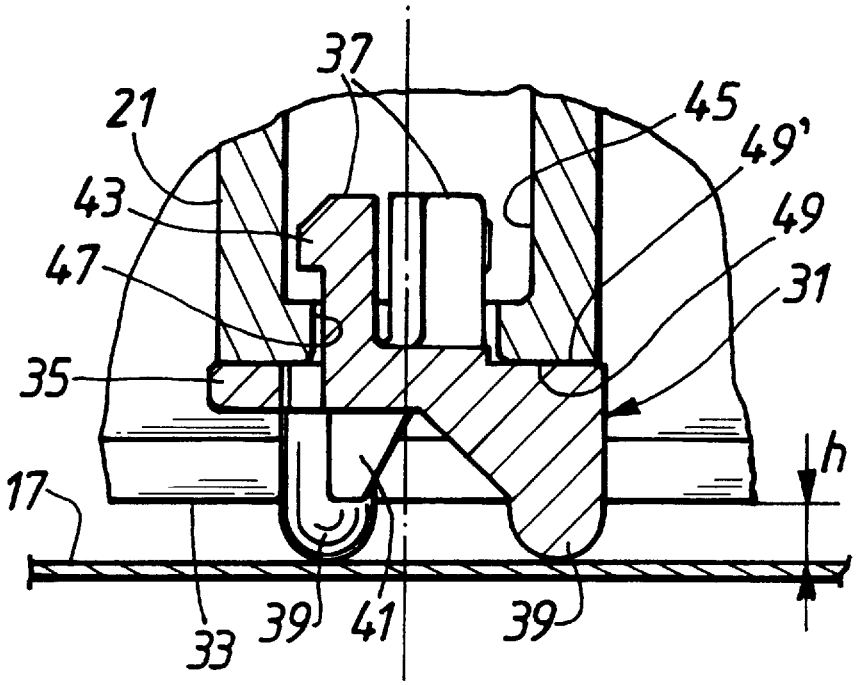
FIG. 2 is an enlarged axial sectional view of the bearing end piece of this agitator lid.

The end piece 31 includes (FIGS. 2 and 3) a body part of disk shape or a circular plate 35 with a diameter equivalent to that of the shaft of the blade 21, three upper snap-fitting hook-type elements 37 (clip tabs) on one and the same circle at an angle of 120° from one another arranged vertically on the central part of the plate 35, and three lower fingers 39 arranged vertically under the plate 35 and also on one and the same circle at an angle of 120° from one another. The entire assembly has axial symmetry as a result of molding in a synthetic material with a low coefficient of friction (a material based on "Teflon").

The fingers 39 have rounded ends and, during agitation, are applied in a localized manner on the surface of the base 17 of the can (in a plane perpendicular to the spindle). They are arranged substantially at the periphery of the plate 35, being held rigidly on the latter by radial ribs 41. Their lateral arrangement increases the adhering engagement with the base of the can, preventing any rotational slipping on this base.

The upper hook elements 37 form the part which rotationally links the end piece to the blade. They have their upper hooking snout 43 turned radially outward and engage by means of snap-fitting in the complementary lower inner cylindrical skirt 45 of the blade shaft. This skirt 45 is developed vertically, enclosing, with a small degree of play, the vertical legs of the hook elements 37 in its lower part of small diameter 47 and receiving, in an underlying part of greater diameter, the snouts 43 of the hooks. This hook-type mounting of the end piece on the blade shaft includes clearance which is adapted on the one hand in terms of the rotational deflection and, on the other hand, in terms of the deflection in the seat plane of the end piece on the surface of the base 17.

The relative rotational slipping of the end piece and the blade is achieved between the opposite horizontal surfaces 49, 49', respectively, of the lower shaft end of the blade and of the corresponding upper surface of the plate. The slipping moment is very low, much lower than the slipping moment of the bearing points of the fingers 39 on the surface of the base 17 of the can.

It will also be noted that, by virtue of the snap-fitting mounting of the end piece, the latter may be easily dismantled by simply removing it with the aid of a screwdriver blade, for example in order to replace it in the event of wear or by another end piece of a different height, depending on the paint treated.

Moreover, as indicated above, the end piece may be mounted, by way of a variant, directly on the agitator spindle rod, at its lower end and not on the blade, the spindle sliding telescopically with a blade fixed on the spindle of the blade sliding in translation on the spindle.

What is claimed is:

1. An agitator lid for a can of coloring substance on paint-agitation machines of the type comprising an agitator spindle (7) mounted so as to be free in translation relative to the lid, said spindle including an axial rod (13) which is driven in rotation and mounting a lower agitation blade (15), the agitator spindle (7) implementing a butt-type application on the base (17) of the can under the thrust of the blade during agitation, wherein the agitator spindle (7) includes at a lower end, an end piece (31) for application on the base of the can, said end piece being mounted so as to be free in rotation on the agitator spindle (7) and being provided with at least three lower projecting elements (39) adapted to come into contact, via one and the same plane perpendicular to the spindle, with the surface of the base (17) of the can.

2. The agitator lid as claimed in claim 1, wherein the end piece (31) is mounted so as to be free in rotation coaxially to the agitator spindle (7).

3. The agitator lid according to claim 1 or 2, wherein said projecting elements (39) come into localized contact with the base (17) of the can.

4. The agitator lid as claimed in claim 1, wherein said end piece (31) is dimensioned in height in relation to the blade (15) so as to bring the blade to a specific optimum operating height relative to the surface of the base (17) of the can.

5. The agitator lid as claimed in claim 1, wherein said end piece (31) is a circular plate (35) having a diameter which is larger than that of the agitator-spindle rod (13), said end piece being mounted perpendicularly to the agitator spindle, the projecting elements (39) being cylindrical fingers each having a rounded end, said fingers being arranged at a circular spacing of 120° from one another.

6. The agitator lid as claimed in claim 1, wherein the end piece (31) is mounted rotationally on the agitator spindle (7) by a snap-fitting device (37) engaging in an end-shaft bore (45, 47) of the agitator spindle (7).

7. The agitator lid as claimed in claim 6, wherein the snap-fitting device (37) has a circular shape and consists of three upper clip tabs fixed in an upper central part of the end piece (31), an upper snout part (43) of said end piece interacting with a complementary cylindrical skirt (45) of a blade shaft.

8. The agitator lid as claimed in claim 1, wherein the agitator spindle (7) has a spirally configured blade (15), said spiral blade (15) being mounted so as to be movable in translation on the agitator-spindle rod (13), the end piece (31) being mounted so as to rotate on the blade (15) at the lower part of the blade coaxially with the blade, and projecting beyond the lower leading edge (33) of the blade by a specific height h corresponding to the application height on the base (17) of the can where operation is optimal.

9. Agitator lid as claimed in claim 8, wherein the agitator-spindle rod (13) has a constant specific length for use with various sizes of cans (11) within a specified capacity range.

10. Agitator lid as claimed in claim 8, wherein the blade (15) has a central shaft (21) and is mounted so as to slide longitudinally with the central shaft (21) on the agitator spindle over a specific path of movement, said, shaft (21) including two longitudinal shoulders (23) which are diametrically opposed and are each provided with an inner groove (25) receiving a complementary rib (27) of the spindle rod (13), upward movement being limited by an upper stop (29) at the top end of each of the grooves and downward movement by a lower stop.

11. Agitator lid a claimed in claim 1, wherein the end piece (31) has an axial symmetry, said end piece being constituted of a molded synthetic material having a low coefficient of friction.

* * * * *